US012690684B2

(12) United States Patent
Murphy

(10) Patent No.: US 12,690,684 B2
(45) **Date of Patent: *Jul. 28, 2026**

(54) RECLINING SEATING UNIT FOR USE IN THEATER WITH RISER ARRANGEMENT

(71) Applicant: Ultra-Mek, Inc., Denton, NC (US)

(72) Inventor: Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 158 days.

This patent is subject to a terminal disclaimer.

(21) Appl. No.: 18/604,615

(22) Filed: Mar. 14, 2024

(65) Prior Publication Data

US 2024/0341479 A1 Oct. 17, 2024

Related U.S. Application Data

(60) Provisional application No. 63/459,027, filed on Apr. 13, 2023.

(51) Int. Cl.
*A47C 1/0355* (2013.01)

(52) U.S. Cl.
CPC ..... *A47C 1/0355* (2013.01)

(58) Field of Classification Search
CPC .... A47C 1/0355; A47C 1/03211; A47C 1/035
See application file for complete search history.

(56) References Cited

U.S. PATENT DOCUMENTS 2,567,612 A * 9/1951 McGehee ..... A47C 3/0255 248/370
4,114,610 A * 9/1978 Koch ..... A61H 1/02 601/24

(Continued)

FOREIGN PATENT DOCUMENTS

EP 3428005 A1 1/2019
JP 2010187821 A 9/2010

OTHER PUBLICATIONS

"International Preliminary Report on Patentability corresponding to International Application No. PCT/US2024/019826 mailed Oct. 23, 2025".

(Continued)

*Primary Examiner* — Medhat Badawi
(74) *Attorney, Agent, or Firm* — Myers Bigel, P.A.

(57) ABSTRACT

A seating unit includes: a frame having a pair of arms, wherein each of the arms includes a cutaway portion in a lower rear area thereof, the cutaway portion configured to receive a tread and a riser of a riser arrangement; a backrest; a seat; a first footrest; a reclining mechanism; and a linear actuator. The reclining mechanism is connected between the backrest, seat, and first footrest, the reclining mechanism comprising a series of pivotally interconnected links and configured to move the seating unit between: (a) an upright position, in which the backrest is disposed at a first generally upright backrest angle relative to the seat, the seat is disposed at a first generally horizontal seat angle, and the first footrest is retracted below a forward portion of the seat; and (b) a fully reclined position, in which the backrest is disposed at a second backrest angle relative to horizontal that is shallower than the first backrest angle, the first footrest is extended in front of the seat, and the seat has a second seat angle that is deeper relative to horizontal than the first seat angle. The reclining mechanism includes a footrest mechanism attached to the first footrest, the footrest mechanism configured to control relative movement of the first footrest relative to the seat. The linear actuator is attached to the reclining mechanism and the footrest linkage and configured to move the backrest, seat and first footrest between the upright and fully reclined positions. The linear actuator and the footrest linkage reside entirely below a front portion of the seat and in front of the cutaway portion of the arms.

22 Claims, 8 Drawing Sheets

(56) References Cited

U.S. PATENT DOCUMENTS 4,915,444 A * 4/1990 Rogers, Jr. ..... A47C 1/0355 297/69
5,326,153 A * 7/1994 Muffi ..... A47C 17/04 297/DIG. 7
5,772,278 A * 6/1998 Kowalski ..... A47C 1/0355 297/85 L
6,540,291 B2 * 4/2003 Hoffman ..... A47C 1/0355 297/84
6,554,354 B1 * 4/2003 Hoffman ..... A47C 7/70 297/145
6,588,841 B1 * 7/2003 Hoffman ..... A47C 3/0255 297/270.3
7,021,711 B1 * 4/2006 Hoffman ..... A47C 3/027 297/270.3
7,475,944 B2 * 1/2009 Griepentrog ..... A47C 17/175 297/85 L
7,607,180 B2 * 10/2009 Griepentrog ..... A47C 17/165 5/47
7,731,276 B2 * 6/2010 Hoffman ..... A47C 1/0355 297/259.2
8,297,693 B2 * 10/2012 Hoffman ..... A47C 3/0255 297/85 M
8,752,890 B2 * 6/2014 Murphy ..... A47C 1/037 297/423.35
9,241,571 B2 * 1/2016 Robertson ..... A47C 1/031
9,332,844 B2 * 5/2016 Regev ..... A47C 3/025
9,655,458 B2 * 5/2017 Jacobs ..... A47C 1/121
10,182,659 B2 * 1/2019 Kuhl ..... A47C 17/86
10,327,553 B2 * 6/2019 Kiwak ..... A47C 3/0251
10,441,081 B2 * 10/2019 Carrera ..... A47C 1/024
D885,783 S * 6/2020 Menescardi ..... D6/381
10,813,457 B2 * 10/2020 Kiwak ..... A47C 1/0345
10,874,574 B1 * 12/2020 Ruby ..... A61G 15/02
10,888,162 B1 * 1/2021 McLennan ..... A47C 1/124
11,076,700 B2 * 8/2021 Kuhl ..... A47C 17/04
11,110,023 B1 * 9/2021 Knight ..... A47C 1/03211
11,122,898 B2 * 9/2021 Kiwak ..... A47C 7/506
11,412,853 B2 * 8/2022 Kiwak ..... A47C 1/0347
11,457,742 B1 * 10/2022 Zhang ..... A47C 4/02
11,478,083 B1 * 10/2022 Li ..... A47C 17/04
11,564,496 B1 * 1/2023 Li ..... A47C 1/0355
12,458,146 B2 * 11/2025 Murphy ..... A47C 1/0345
2002/0093227 A1 * 7/2002 Williams ..... A47C 17/04 297/116
2002/0149238 A1 * 10/2002 Hoffman ..... A47C 1/03255 297/85 R
2003/0015893 A1 * 1/2003 Hoffman ..... G06F 17/142 297/85 R
2003/0022771 A1 * 1/2003 Stearns ..... A63B 21/4047 482/142
2003/0022772 A1 * 1/2003 Stearns ..... A63B 23/0405 482/142
2003/0070225 A1 * 4/2003 Murphy ..... A47C 17/2076 5/13
2005/0104420 A1 * 5/2005 Murphy ..... A47C 1/0355 297/85 L
2005/0146179 A1 * 7/2005 Murphy ..... A47C 1/124 297/248
2005/0253430 A1 * 11/2005 George ..... A47C 1/124 297/233
2006/0108840 A1 * 5/2006 Murphy ..... A47C 1/0355 297/68
2006/0284451 A1 * 12/2006 Hoffman ..... A47C 3/16 297/125
2006/0290174 A1 * 12/2006 Hoffman ..... A47C 1/0355 297/84
2007/0126267 A1 * 6/2007 Hoffman ..... A47C 1/0355 297/84
2007/0151023 A1 * 7/2007 Murphy ..... A47C 17/17 5/13
2007/0163475 A1 * 7/2007 Murphy ..... A47B 9/00 108/147
2007/0252422 A1 * 11/2007 Beaver ..... A47C 7/506 297/423.24
2007/0283491 A1 * 12/2007 Murphy ..... A47C 17/213 5/13
2008/0012396 A1 * 1/2008 Hoffman ..... A47C 1/0355 297/85 L
2008/0023992 A1 * 1/2008 Hoffman ..... A47C 1/0242 297/85 R
2008/0036248 A1 * 2/2008 Beaver ..... A47C 1/0355 297/329
2009/0072593 A1 * 3/2009 Hoffman ..... A47C 1/037 297/408
2009/0235452 A1 * 9/2009 Hoffman ..... A47C 17/2076 5/13
2010/0127538 A1 * 5/2010 Hoffman ..... A47C 3/18 297/68
2010/0127555 A1 * 5/2010 Hoffman ..... A47C 3/0255 297/344.21
2010/0127556 A1 * 5/2010 Hoffman ..... A47C 1/0355 297/84
2010/0283297 A1 * 11/2010 Crum ..... A47C 7/50 297/423.28
2011/0010846 A1 * 1/2011 Murphy ..... A47C 17/04 5/2.1
2011/0010847 A1 * 1/2011 Murphy ..... A47C 17/04 5/35
2011/0018331 A1 * 1/2011 Murphy ..... A47C 1/0355 297/85 R
2011/0291460 A1 * 12/2011 Murphy ..... A61G 5/14 297/85 M
2011/0304193 A1 * 12/2011 Murphy ..... A47C 1/034 297/85 M
2012/0104827 A1 * 5/2012 Murphy ..... A47C 1/037 297/85 M
2012/0112517 A1 * 5/2012 Hoffman ..... A47C 1/0355 297/85 L
2012/0112518 A1 * 5/2012 Murphy ..... A47C 1/0355 297/85 L
2012/0112519 A1 * 5/2012 Murphy ..... A47C 1/0355 297/85 M
2012/0146364 A1 * 6/2012 Hoffman ..... A47C 1/03266 297/84
2012/0286557 A1 * 11/2012 Hoffman ..... A47C 1/03211 297/85 M
2013/0011335 A1 * 1/2013 Xie ..... G01N 33/5008 514/19.5
2013/0014327 A1 * 1/2013 Downey ..... A47C 7/42 5/632
2013/0140855 A1 * 6/2013 Murphy ..... A47C 1/037 297/61
2013/0140856 A1 * 6/2013 Murphy ..... A47C 1/037 297/61
2013/0200658 A1 * 8/2013 Hoffman ..... A47C 1/0342 297/75
2013/0200659 A1 * 8/2013 Hoffman ..... A47C 1/035 297/84
2014/0167482 A1 * 6/2014 Myre ..... A47C 7/002 297/463.1
2014/0345044 A1 * 11/2014 Murphy ..... A47C 17/225 5/14
2015/0135432 A1 * 5/2015 Murphy ..... A47C 17/16 5/29
2015/0342358 A1 * 12/2015 Murphy ..... A61G 7/012 5/400
2016/0045031 A1 * 2/2016 Lawson ..... A47C 7/506 297/284.3
2016/0051057 A1 * 2/2016 Murphy ..... A47C 17/2073 5/29
2016/0088942 A1 * 3/2016 Murphy ..... A47C 1/0345 297/361.1
2016/0100686 A1 * 4/2016 Regev ..... A47C 7/5068 297/270.1
2016/0100687 A1 * 4/2016 Murphy ..... A47C 1/0347 297/271.3
2017/0071353 A1 * 3/2017 Murphy ..... A47C 17/165
2017/0202359 A1 * 7/2017 Murphy ..... A47C 17/207

(56) References Cited

U.S. PATENT DOCUMENTS

2018/0027968 A1* 2/2018 Lawson ..... A47C 1/0355
2018/0064258 A1* 3/2018 Murphy ..... A47C 17/138
2018/0103761 A1* 4/2018 White ..... A47C 1/0352
2018/0161223 A1* 6/2018 Murphy ..... A61G 5/128
2018/0206644 A1* 7/2018 Murphy ..... A47C 3/18
2020/0085197 A1* 3/2020 Lucas ..... A47C 15/004
2020/0100593 A1* 4/2020 He ..... A47C 7/38
2020/0100596 A1* 4/2020 He ..... A47C 17/00
2020/0163458 A1* 5/2020 Murphy ..... A47C 1/0355
2020/0352333 A1* 11/2020 Lapointe ..... A47C 1/0242
2021/0022506 A1* 1/2021 Murphy ..... A47C 1/03211
2021/0100364 A1* 4/2021 Murphy ..... A47C 1/0355
2022/0378207 A1* 12/2022 Murphy ..... A47C 1/0355
2022/0400863 A1* 12/2022 Murphy ..... A47C 1/0242
2023/0010099 A1* 1/2023 Murphy ..... A47C 1/037
2023/0017194 A1* 1/2023 Slater ..... A47C 17/04
2023/0068014 A1* 3/2023 Sun ..... A47C 1/03211
2023/0200536 A1* 6/2023 Beech ..... A47C 31/008
297/463.1
2023/0232987 A1* 7/2023 Brandtner ..... A47C 5/12
297/452.55
2023/0380597 A1* 11/2023 Li ..... A47C 1/0355
2024/0023713 A1* 1/2024 Murphy ..... A47C 1/0345
2024/0041215 A1* 2/2024 Spong ..... A47C 1/03255
2024/0049885 A1* 2/2024 Kamiya ..... A47C 7/54
2024/0081540 A1* 3/2024 Chen ..... A47C 7/541
2024/0122346 A1* 4/2024 Murphy ..... A47C 1/0355
2024/0138568 A1* 5/2024 Yang ..... A47C 1/0355
2024/0138569 A1* 5/2024 Murphy ..... A47C 3/0255
2024/0138577 A1* 5/2024 Yang ..... A47C 1/03211
2024/0148144 A1* 5/2024 Li ..... A47C 1/0345
2024/0148145 A1* 5/2024 Li ..... A47C 1/0355
2024/0148148 A1* 5/2024 Shao ..... A47C 4/028
2024/0156262 A1* 5/2024 Li ..... A47C 1/0355
2024/0156263 A1* 5/2024 Li ..... A47C 1/0347
2024/0156274 A1* 5/2024 Hall ..... B66D 1/60
2024/0164527 A1* 5/2024 Li ..... A47C 7/5068
2024/0206632 A1* 6/2024 Shi ..... A47C 19/022
2024/0215726 A1* 7/2024 Li ..... A47C 1/0345
2024/0277145 A1* 8/2024 Li ..... A61G 5/14
2024/0277150 A1* 8/2024 Cooper ..... A47C 15/006
2024/0298805 A1* 9/2024 Li ..... A47C 7/5068
2024/0335039 A1* 10/2024 Lake ..... A47C 1/0355
2024/0335042 A1* 10/2024 Liu ..... A47C 1/024
2024/0341478 A1* 10/2024 Zhao ..... A47C 3/03
2024/0341479 A1* 10/2024 Murphy ..... A47C 1/0355
2024/0358156 A1* 10/2024 Wu ..... A47C 7/546
2024/0365979 A1* 11/2024 Lawson ..... A47C 1/0355
2024/0374031 A1* 11/2024 Tan ..... A47C 1/0355
2024/0374032 A1* 11/2024 Sun ..... A47C 1/0355
2024/0389751 A1* 11/2024 Sun ..... A47C 1/03211
2024/0407545 A1* 12/2024 Shi ..... H04R 1/025
2024/0423369 A1* 12/2024 Loccioni ..... A47C 1/0342
2025/0000260 A1* 1/2025 Cai ..... A47C 1/0355
2025/0040708 A1* 2/2025 Lake ..... A47C 1/0345
2025/0040709 A1* 2/2025 Lake ..... A47C 1/0355
2025/0057317 A1* 2/2025 Zhou ..... A47C 17/86
2025/0072612 A1* 3/2025 Zhao ..... A47C 1/0355
2025/0082099 A1* 3/2025 Ye ..... A47C 1/03211
2025/0089902 A1* 3/2025 Chen ..... A47C 17/2076
2025/0098864 A1* 3/2025 Shi ..... A47C 7/541
2025/0107624 A1* 4/2025 Dick ..... A47C 1/0355
2025/0134256 A1* 5/2025 Conner ..... A47C 7/54
2025/0151906 A1* 5/2025 Yang ..... A47C 1/0355
2025/0151908 A1* 5/2025 Lei ..... A47C 1/0355
2025/0160520 A1* 5/2025 Cai ..... A47C 1/0345
2025/0160521 A1* 5/2025 Cai ..... A47C 1/0345
2025/0228368 A1* 7/2025 Wang ..... A47C 1/03211
2025/0248521 A1* 8/2025 Jiang ..... A47C 1/0345
2025/0261757 A1* 8/2025 Crum ..... A47C 1/03211
2025/0280955 A1* 9/2025 Murphy ..... A47C 15/004
2025/0288112 A1* 9/2025 Ding ..... A47C 7/624
2025/0288116 A1* 9/2025 Shi ..... A47C 17/04
2025/0295236 A1* 9/2025 Johnson ..... A47C 1/12

OTHER PUBLICATIONS

"International Search Report and Written Opinion of the International Searching Authority", International Application No. PCT/US2024/019826, Jul. 1, 2024, 16 pp.

* cited by examiner

RECLINING SEATING UNIT FOR USE IN THEATER WITH RISER ARRANGEMENT

RELATED APPLICATION

This application claims priority from and the benefit of U.S. Provisional Patent Application No. 63/459,027, filed Apr. 13, 2023, the disclosure of which is hereby incorporated therein by reference in full.

FIELD OF THE INVENTION

The present invention relates generally to seating units, and relates more particularly to reclining seating units.

BACKGROUND OF THE INVENTION

Recliner chairs and other reclining seating units have proven to be popular with consumers. These seating units typically move from an upright position, in which the backrest is generally upright, to one or more reclined positions, in which the backrest pivots to be less upright. The movement of the seating unit between the upright and reclined positions is typically controlled by a pair of matching reclining mechanisms that are attached to the seat, backrest and base of the chair.

One particularly popular recliner is the "three-way" recliner, which has two reclined positions: a "TV position", in which the footrest or ottoman of the chair is projected forwardly from the chair while the backrest remains substantially upright; and a "fully reclined position", in which the backrest is less upright (i.e., it has been reclined to a shallower angle relative to the floor). In a "three-way" recliner, the backrest pivots relative to the seat as the chair takes its fully reclined position; this differs from a "two-way" recliner, in which the backrest and seat are rigidly fixed and do not pivot relative to one another as the chair moves to the fully reclined position. Many three-way recliners are constructed such that the backrest and footrest are coupled to one another, such that reclining of the backrest cannot occur unless the footrest is already extended (i.e., the chair is in the TV position). See, e.g., U.S. Pat. No. 4,915,444 to Rogers, Jr. and U.S. Pat. No. 6,540,291 to Hoffman, which illustrate chairs of rather contemporary style with three-way reclining capability. Other reclining chairs may have decoupled reclining and footrest-extending mechanisms. See, e.g., U.S. Pat. No. 7,731,276 to Hoffman et al. Some reclining units have employed power actuators to recline the backrest and extend the footrest. See, e.g., U.S. Pat. No. 8,297,693 to Hoffman et al.

With the ubiquity and variety of reclining seating units (and their accompanying reclining mechanisms), reclining seating units now appear in many locations outside the home. One place that has been popular for the installation of reclining seating units is movie theaters, particularly those trying to compete with "home theater" experiences. However, retrofitting existing theaters with reclining seats can be challenging because of the presence of riser arrangements within the theaters, which provide a platform or foundation for theater seats that place the seats that the rear of the theater at a higher elevation than the seats in the front. Riser arrangements are typically configured similar to the steps of a staircase, with alternating horizontal "treads" and vertical "risers" that form the "steps." Typical conventional theater seats are mounted on the treads. However, if a reclining seating unit is to be installed, typically a portion of the tread and riser must be removed in order to have room for a reclining seating unit and its reclining mechanism. This can be very expensive (often prohibitively expensive), thus putting the existing theater at a competitive disadvantage to newer theaters. Thus, it may be desirable to provide a reclining seating unit that can be retrofitted into a theater with a conventional riser arrangement.

SUMMARY

As a first aspect, embodiments of the invention are directed to a reclining seating unit. The seating unit comprises: a frame having a pair of arms, wherein each of the arms includes a cutaway portion in a lower rear area thereof, the cutaway portion configured to receive a tread and a riser of a riser arrangement; a backrest; a seat; a first footrest; a reclining mechanism; and a linear actuator. The reclining mechanism is connected between the backrest, seat, and first footrest, the reclining mechanism comprising a series of pivotally interconnected links and configured to move the seating unit between: (a) an upright position, in which the backrest is disposed at a first generally upright backrest angle relative to the seat, the seat is disposed at a first generally horizontal seat angle, and the first footrest is retracted below a forward portion of the seat; and (b) a fully reclined position, in which the backrest is disposed at a second backrest angle relative to horizontal that is shallower than the first backrest angle, the first footrest is extended in front of the seat, and the seat has a second seat angle that is deeper relative to horizontal than the first seat angle. The reclining mechanism includes a footrest mechanism attached to the first footrest, the footrest mechanism configured to control relative movement of the first footrest relative to the seat. The linear actuator is attached to the reclining mechanism and the footrest linkage and configured to move the backrest, seat and first footrest between the upright and fully reclined positions. The linear actuator and the footrest linkage reside entirely below a front portion of the seat and in front of the cutaway portion of the arms.

As a second aspect, embodiments of the invention are directed to a reclining seating unit comprising: a frame having a pair of arms; a backrest; a seat; a first footrest; a reclining mechanism; and a linear actuator. The reclining mechanism is connected between the backrest, seat, and first footrest, the reclining mechanism comprising a series of pivotally interconnected links and configured to move the seating unit between: (a) an upright position, in which the backrest is disposed at a first generally upright backrest angle relative to the seat, the seat is disposed at a first generally horizontal seat angle, and the first footrest is retracted below a forward portion of the seat; and (b) a fully reclined position, in which the backrest is disposed at a second backrest angle relative to horizontal that is shallower than the first backrest angle, the first footrest is extended in front of the seat, and the seat has a second seat angle that is deeper relative to horizontal than the first seat angle. The reclining mechanism includes a footrest mechanism attached to the first footrest, the footrest mechanism configured to control relative movement of the first footrest relative to the seat. The linear actuator is attached to the reclining mechanism and the footrest linkage and configured to move the backrest, seat and first footrest between the upright and fully reclined positions. The linear actuator includes a rail, and wherein the rail defines an angle relative to horizontal of at least 30 degrees in the upright position.

As a third aspect, embodiments of the invention are directed to a reclining seating unit comprising: a frame having a pair of arms, wherein each of the arms includes a cutaway portion in a lower rear area thereof, the cutaway portion configured to receive a tread and a riser of a riser arrangement; a backrest; a seat; a first footrest; a reclining mechanism; and a linear actuator. The reclining mechanism is connected between the backrest, seat, and first footrest, the reclining mechanism comprising a series of pivotally interconnected links and configured to move the seating unit between: (a) an upright position, in which the backrest is disposed at a first generally upright backrest angle relative to the seat, the seat is disposed at a first generally horizontal seat angle, and the first footrest is retracted below a forward portion of the seat; and (b) a fully reclined position, in which the backrest is disposed at a second backrest angle relative to horizontal that is shallower than the first backrest angle, the first footrest is extended in front of the seat, and the seat has a second seat angle that is deeper relative to horizontal than the first seat angle. The reclining mechanism includes a footrest mechanism attached to the first footrest, the footrest mechanism configured to control relative movement of the first footrest relative to the seat. The linear actuator is attached to the reclining mechanism and the footrest linkage and configured to move the backrest, seat and first footrest between the upright and fully reclined positions. The reclining mechanism includes a seat frame that underlies and moves with the seat, the footrest linkage includes a lower footrest swing link, the reclining mechanism further includes a coupling link that is pivotally attached to the arm frame, and the lower footrest swing link and the coupling link are pivotally attached to each other and to the seat frame at a first pivot point. The first pivot point is movable relative to the seat frame within an arcuate slot.

As a fourth aspect, embodiments of the invention are directed to a reclining seating unit comprising: a frame having a pair of arms; a backrest; a seat; a first footrest; and a reclining mechanism connected between the backrest, seat, and first footrest, the reclining mechanism comprising a series of pivotally interconnected links and configured to move the seating unit between: (a) an upright position, in which the backrest is disposed at a first generally upright backrest angle relative to the seat, the seat is disposed at a first generally horizontal seat angle, and the first footrest is retracted below a forward portion of the seat; and (b) a fully reclined position, in which the backrest is disposed at a second backrest angle relative to horizontal that is shallower than the first backrest angle, the first footrest is extended in front of the seat, and the seat has a second seat angle that is deeper relative to horizontal than the first seat angle. The reclining mechanism includes a footrest mechanism attached to the first footrest, the footrest mechanism configured to control relative movement of the first footrest relative to the seat. The seating unit further includes a first linear actuator attached to the reclining mechanism and the footrest linkage and configured to move the seat and first footrest between the upright and fully reclined positions, and a second linear actuator attached to the backrest and configured to move the backrest between upright and fully reclined positions. The first linear actuator includes a rail, and wherein the rail defines an angle relative to horizontal of at least 30 degrees in the upright position.

DETAILED DESCRIPTION

Figure 1:
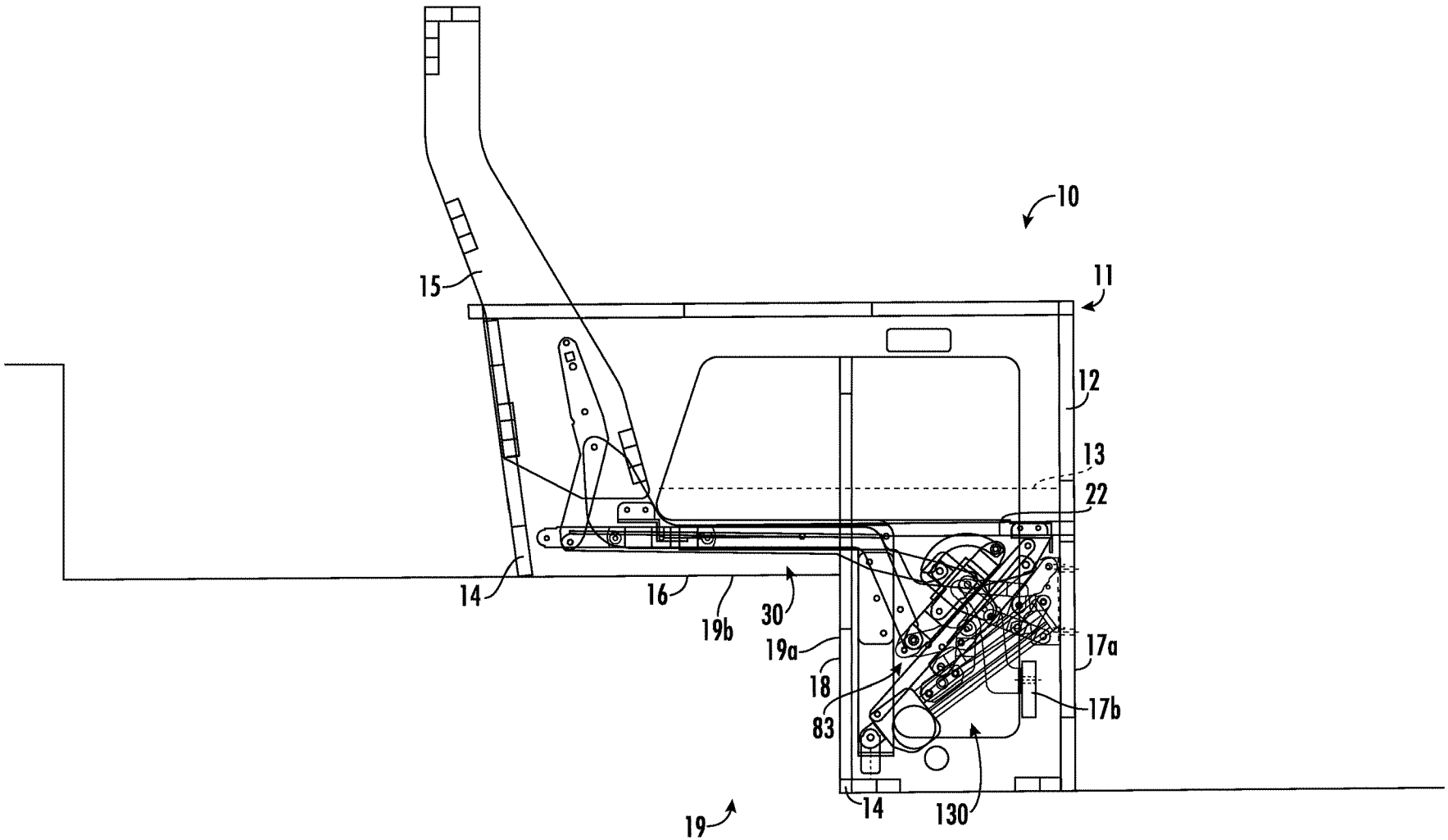
FIG. 1 is a side view of a seating unit mounted on a riser arrangement according to embodiments of the invention, wherein the seating unit is shown in the upright position.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

The seating units illustrated and described herein comprise a plurality of pivotally interconnected links. Those skilled in this art will appreciate that the pivots between links can take a variety of configurations, such as pivot pins, rivets, bolt and nut combinations, and the like, any of which would be suitable for use with the present invention. Also, the shapes of the links may vary as desired, as may the locations of certain of the pivots. Moreover, in some instances combinations of pivot points may be replaced by equivalent structures, such as "slider-crank" configurations, like those described in B. Paul, *Kinematics and Dynamics of Planar Machinery* 4-21 (1979).

Referring now to the drawings, a seating unit (such as a chair) according to embodiments of the invention is illustrated in FIGS. 1-6 and designated broadly at 10. The chair 10 includes an arm frame 11 with opposed arms 12 that are connected by cross-members 14. The arm frame 11 has a cutaway area 19 that includes perpendicular front and upper edges 19*a*, 19*b* and is configured to enable the arm frame 11 to rest and be mounted on a tread 16 and riser 18 of a riser arrangement, such as may be found in a theater. The seating unit 10 also includes a seat 13 that is generally horizontally disposed above the tread 16 and includes an underlying open seat frame 22, a backrest 15 that is generally vertically and disposed substantially above a rear portion of the seat 13, and two footrests 17*a*, 17*b*, which, in the upright position of FIG. 1, are generally vertically disposed below a front portion of the seat 13 and in front of the riser 18.

The seat 13, backrest 15 and footrests 17*a*, 17*b* are interconnected with the arm frame 11 and with each other via a pair of reclining mechanisms 30. The reclining mechanisms 30 are mirror images of each other relative to a vertical plane P (FIG. 5) that is disposed midway between the arms 12. As such, only one reclining mechanism 30 will be described herein, with the understanding that the discussion is equally applicable to the mirror image reclining mechanism 30. Also, as used herein, the terms "front," "forward" and the like refer to a horizontal direction defined by a vector the originates in the backrest and extends parallel to the plane P toward the footrests (in other words, the forward direction is consistent with an occupant of the seating unit facing forward). The term "rear" and the like refer to the direction opposite to the forward direction. Together the front and rear directions make up the "longitudinal" dimension of the seating unit 10. The "lateral" dimension of the seating unit 10 is perpendicular to the plane P.

Figure 2:
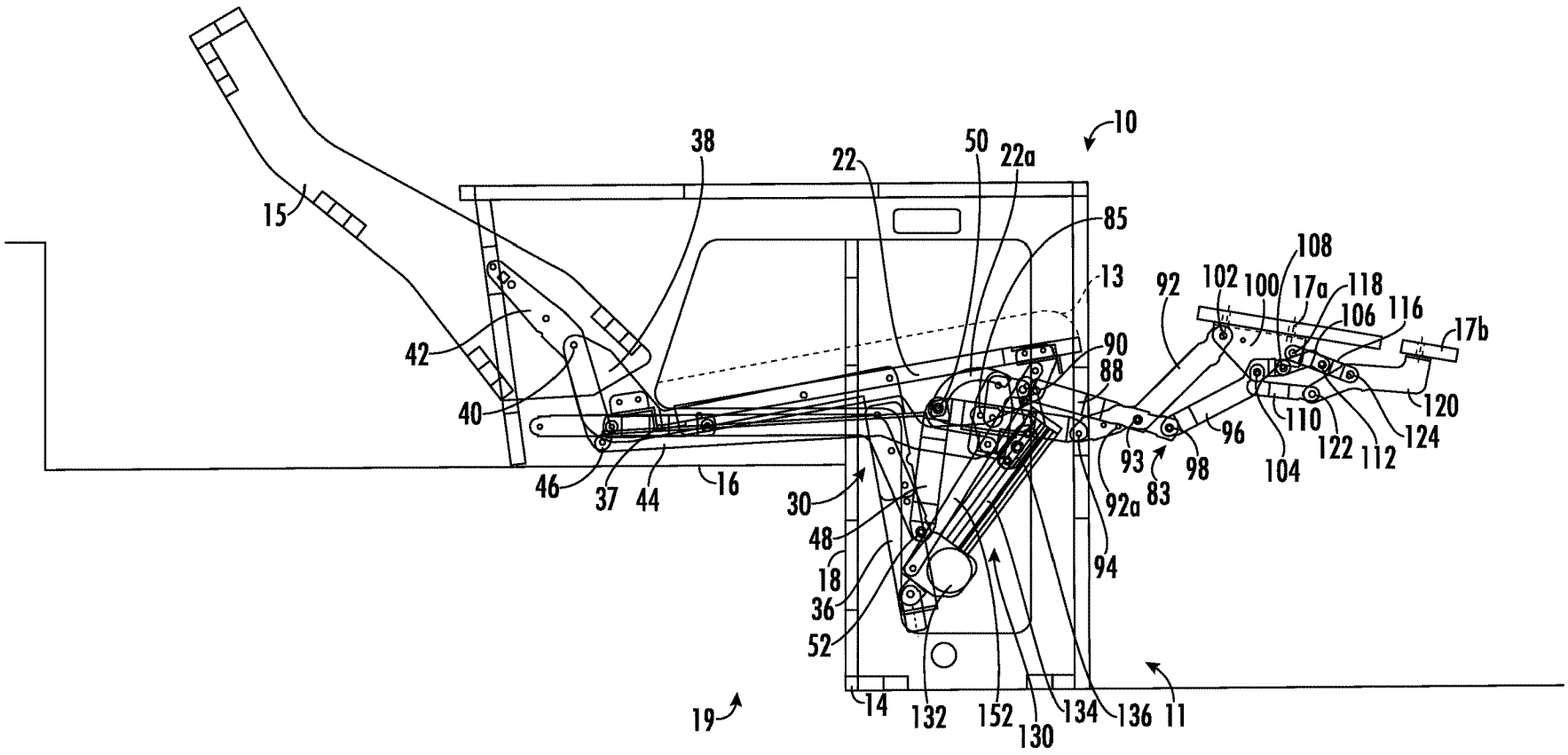
FIG. 2 is a side view of the seating unit of FIG. 1, shown in the fully reclined position.
Figure 3:
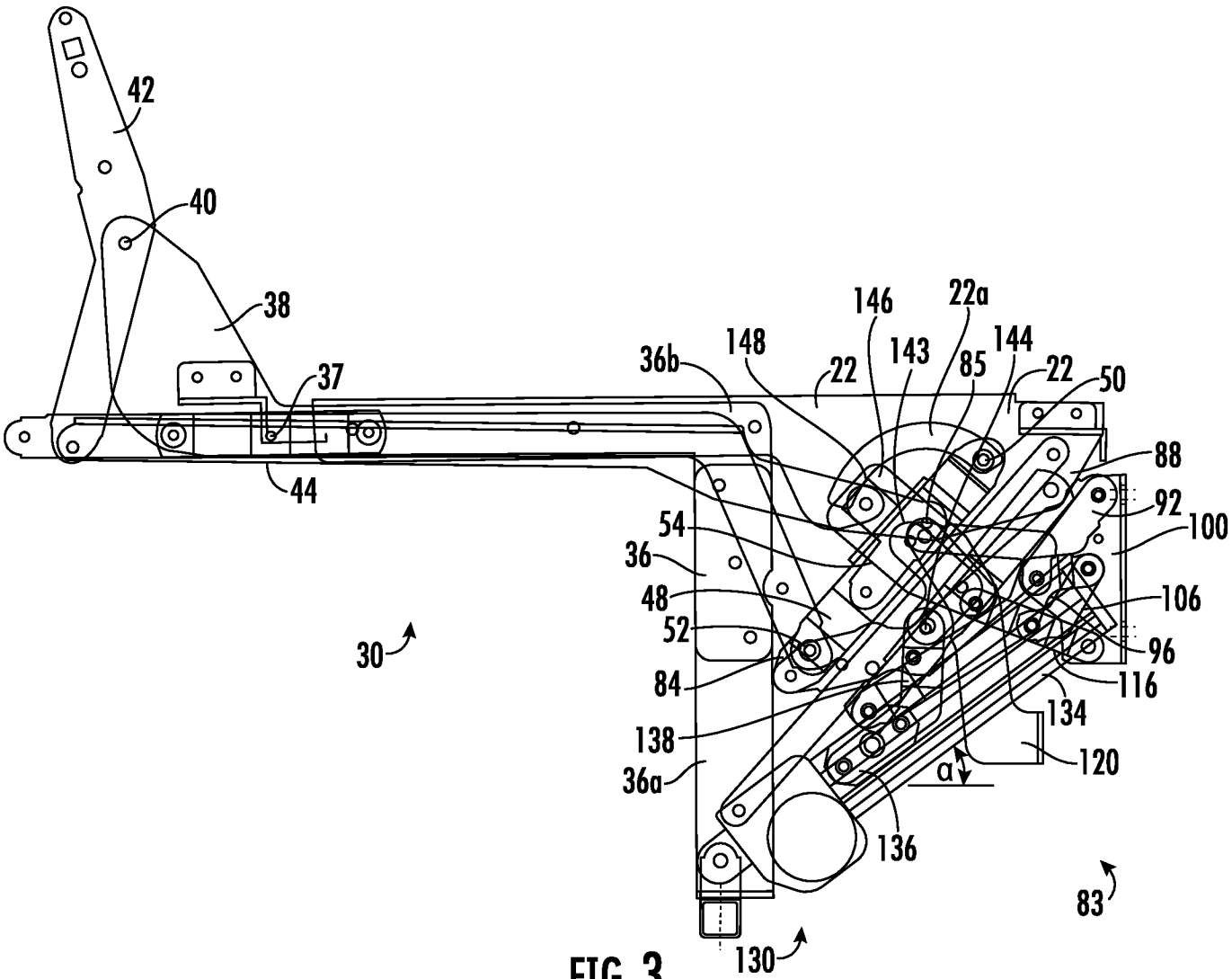
FIG. 3 is a side view of the reclining mechanism of the seating unit of FIG. 1, shown in the upright position.
Figure 4:
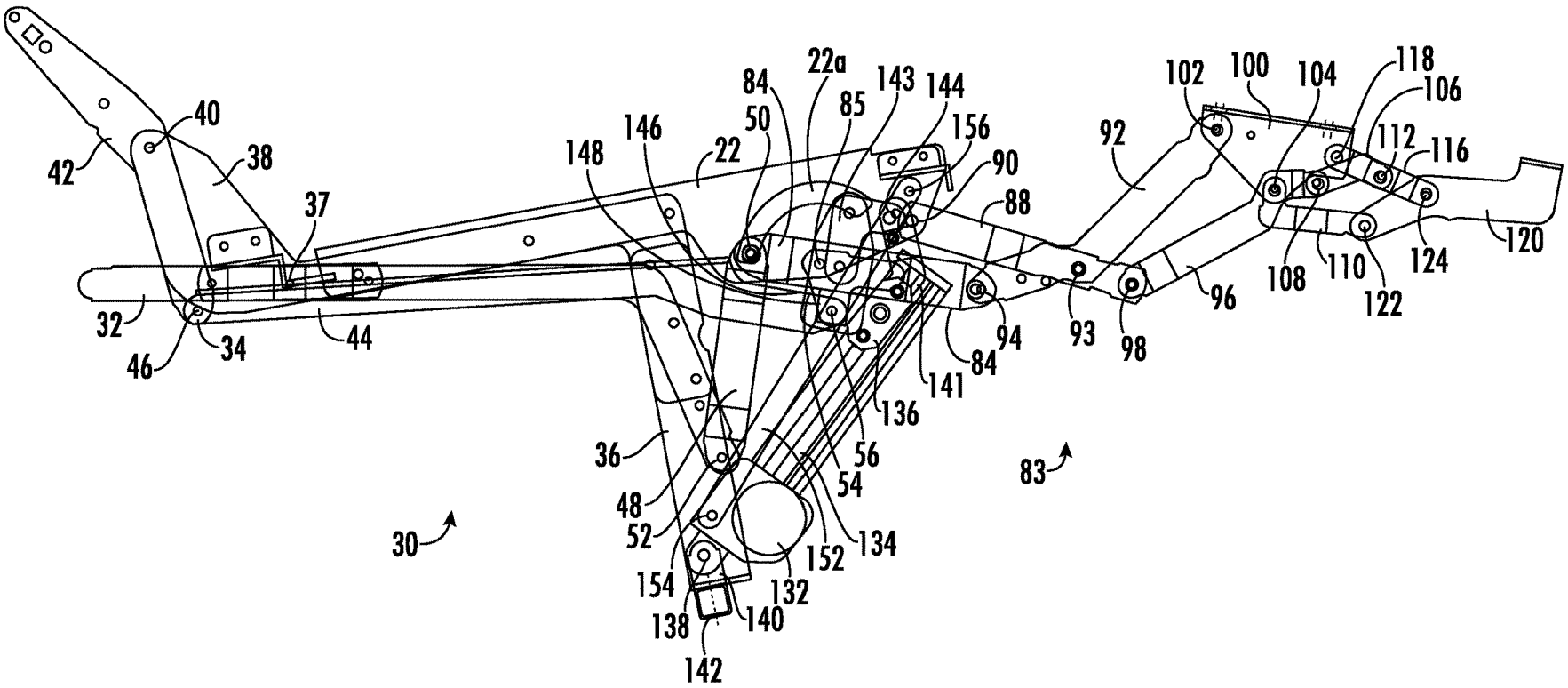
FIG. 4 is a side view of the reclining mechanism of the seating unit of FIG. 1, shown in the fully reclined position.
Figure 5:
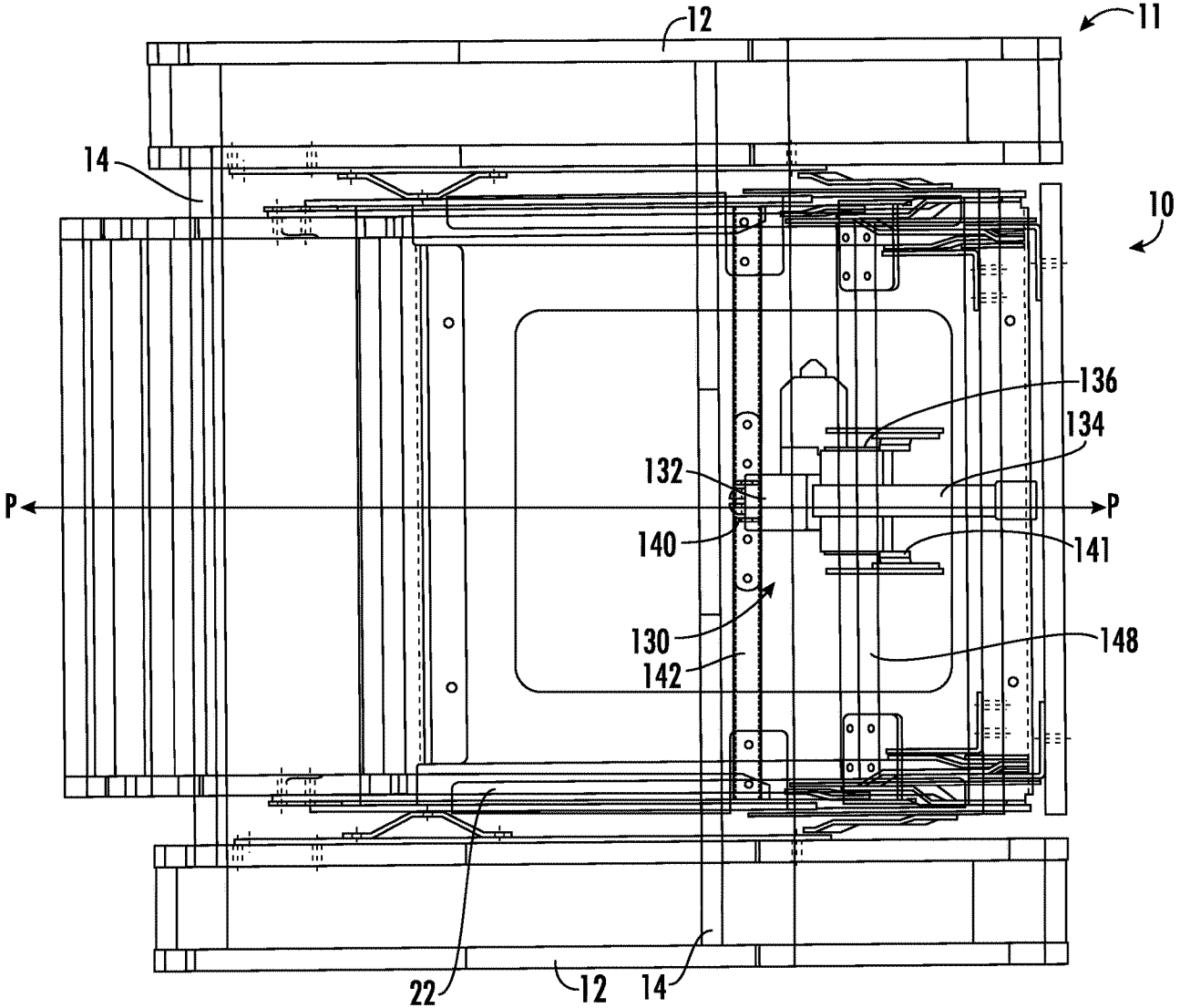
FIG. 5 is a top view of the seating unit of FIG. 1, shown in the upright position.
Figure 6:
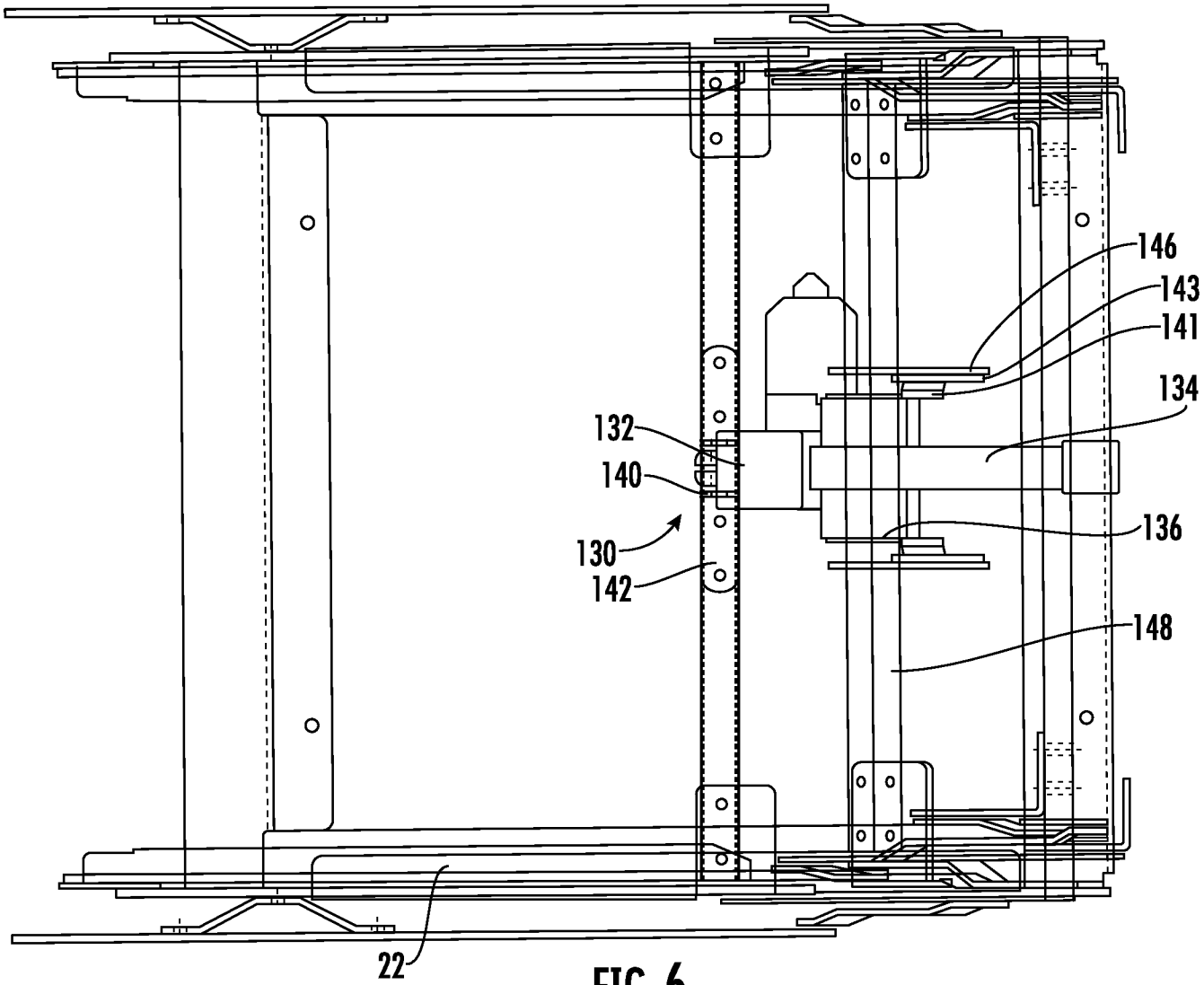
FIG. 6 is a top view of the reclining mechanism of the seating unit of FIG. 1, shown in the upright position.

Further, the reclining mechanisms 30 are configured to move the seating unit 10 between an upright position, in which the backrest 15 is generally upright, the seat 13 is generally horizontal, and the footrests 17*a*, 17*b* are disposed beneath the front portion of the seat 13 (see FIGS. 1, 3, 5 and 6), and a fully reclined position, in which the backrest 15 is reclined relative to its disposition in the upright position, and the footrests 17*a*, 17*b* are disposed in front of the seat 13 (see FIGS. 2 and 4). For the sake of clarity, the reclining mechanisms 30 will first be described in the fully reclined position.

Referring now to FIGS. 2 and 4, the reclining mechanism 30 includes an angled foundation link 32 that is mounted in the inner surface of the arm 12. A spacing link 34 is fixedly mounted near the rear end of the foundation link 32. A carrier link 36 is pivotally mounted to the spacing link 34 at a pivot 37. The carrier link 36 includes a rear projection 38 that extends upwardly from the rear end of the carrier link 36 to a pivot 40 with a backpost 42 that is fixed to the backrest 15. The carrier link 36 extends forwardly, then downwardly, from the rear projection 38, to terminate in front of the riser 18.

The seat frame 22 is fixed to the carrier link 36 and extends forwardly from the rear projection 38 to terminate beneath the front portion of the seat 13. A coupling link 48 is attached at its upper end to the seat link 22 via a pin 50 that fits within an arcuate slot 22*a* in the seat link 22. In the fully reclined position of FIGS. 2 and 4, the pin 50 is located in the rear end of the slot 22*a*. The lower end of the coupling link 48 is attached to the lower end of the foundation link 32 at a pivot 52.

A connecting link 44 is attached at its rear end to the lower end of the backpost 42 at a pivot 46. The forward end of the connecting link 44 is attached to an extension 54 of a lower footrest swing link 84 (discussed further below) at a pivot 56.

The reclining mechanism 30 also includes a footrest linkage 83 with the aforementioned lower footrest swing link 84 being attached at a middle portion thereof to the seat frame 22 at a pivot 85. The lower footrest swing link 84 is also attached to the upper end of the coupling link 48 at a pivot that coincides with the pin 50. The lower footrest swing link 84 extends forwardly from the pin 50. An upper footrest swing link 88 is also attached to the seat frame 22 at a pivot 90 and extends forwardly therefrom. An upper footrest extension link 92 is attached to the forward end of the lower footrest swing link 84 at a pivot 94 and extends upwardly and forwardly therefrom. The upper footrest extension link 92 is also attached to the upper footrest swing link 88 at a pivot 93. A lower footrest extension link 96 is attached to the forward end of the upper footrest swing link 88 at a pivot 98 and extends forwardly and upwardly therefrom. A main footrest bracket 100 is attached to the forward ends of the upper footrest extension link 92 and the lower footrest extension link 96 at, respectively, pivots 102, 104. The main footrest 17*a* is mounted on the main footrest bracket 100 (FIG. 2).

A lower auxiliary footrest swing link 110 is attached to the main footrest bracket 100 at the pivot 104, and an upper auxiliary footrest swing link 116 is attached to the main footrest bracket 100 at a pivot 118. An auxiliary footrest bracket 120 is attached to the front ends of the swing links 110, 116 at, respectively, pivots 122, 124. A control link 106 is attached to the forward end of the lower footrest extension link 96 at a pivot 108 and to the upper auxiliary footrest swing link 116 at a pivot 112. The auxiliary footrest 17*b* is mounted on the auxiliary footrest bracket 120 (FIG. 2).

Movement of the seating unit 10 between the upright position (FIGS. 1, 3, 5 and 6) and the fully reclined position (FIGS. 2 and 4) is initiated and controlled by a linear actuator 130. Referring to FIGS. 2 and 4-6, the linear actuator 130 includes a motor 132, a rail 134 that extends from the motor 132, and a carriage 136 that slides relative to the rail 134, with its position being controlled by the motor 132. The motor 132 is attached via a pivot 138 to a bracket 140 that is in turn fixed to a cross-member 142. The cross-member 142 is fixed to the lower end of the carrier link 36. The carriage 136 is fixed to an angled extension 141. The extension 141 is attached at its free end to a crank 143 at a pivot 144. The crank 143 is fixed to a bracket 146 that is fixed to the upper surface of a cross-member 148. The cross-member 148 is fixed to the underside of the lower footrest swing link 84. As such, movement of the carriage 136 of the linear actuator 130 moves the lower footrest swing link 84. In addition, a lengthy brace 152 is fixed at one end to a lower portion of the carrier link 36 above the pivot 38, and at the other end to the seat link 22 above the pivot 90.

Movement of the seating unit 10 from the upright position (FIGS. 1, 3, 5 and 6) to the fully reclined position (FIGS. 2 and 4) will now be described. Referring to FIGS. 1 and 3, in the upright position the carriage 136 of the linear actuator 130 is in its rearmost position on the rail 134. The crank 143 is positioned above the pivot 144. The lower footrest swing link 84 is oriented with the pin/pivot 50 in the forward end of the slot 22*a* of the seat link 22, and with the remainder of the lower footrest swing 84 extending downwardly and rearwardly therefrom. The remainder of the footrest linkage 83 of the reclining mechanism 30 is folded in a scissors-like manner under the front portion of the seat 13, with the main footrest 17*a* generally vertically disposed just forward of the seat 13, and the auxiliary footrest 17*b* generally vertically disposed rearward of the main footrest 17*a*. The coupling link 48 is disposed substantially parallel to the lower footrest swing link 84. The carrier link 36 is disposed such that its forward segment 36*a* is substantially vertically disposed in front of the riser 18, and its rearward segment 36*b* is substantially horizontally disposed above the tread 16. The linear actuator 130 is oriented such that the rail 134 is titled upwardly from the motor 132; typically, the angle $\alpha$ of the rail 134 relative to horizontal (e.g., relative to the tread 16) is between about 30 and 45 degrees, and in some embodiments at least 30 degrees. As a result of the orientation of the above-described links, the seat frame 22 (and in turn the seat 13) is substantially horizontally disposed, and the backpost 42 (and in turn the backrest 15) is generally upright, with a slight (e.g., 10-20 degrees) rearward tilt for an occupant seated in the seating unit 10.

To move the seating unit 10 from the upright position of FIGS. 1 and 3 to the fully reclined position of FIGS. 2 and 4, the occupant of the seating unit 10 activates the linear actuator 130. Typically the seating unit 10 will include a toggle switch, joystick, buttons, or some other actuation device that is operatively coupled to the motor 132 to induce the motor 132 to drive the carriage 136 along the rail 134. As the carriage 136 moves forwardly and upwardly, the extension 138 causes the crank 143 to rotate (counterclockwise from the vantage point of FIG. 3). Rotation of the crank 143 causes the bracket 146 and the cross-member 148 to rotate counterclockwise also. This rotation causes the lower footrest swing link 84 to rotate counterclockwise about the pivot 85, which forces the pin 50 rearwardly in the slot 22*a*. The rotation of the lower footrest swing link 84 drives the upper footrest extension link 92 forwardly, which in turn rotates the upper footrest swing link 88 about the pivot 90. Rotation of the upper footrest swing link 88 drives the lower footrest extension link 96 forwardly and causes it to separate slightly from the upper footrest extension link 92. The relative movement of the upper and lower footrest extension links 92, 96 rotates the main ottoman bracket 100 counterclockwise to a generally horizontal position. Relative rotation of the main ottoman bracket 100 and the lower footrest extension link 96 also forces the control link 106 away from the main footrest bracket 100, which extends the upper auxiliary footrest swing link 116 and, in turn, the auxiliary footrest bracket 120. Extension ceases when the upper footrest swing link 88 strikes a pin 92*a* on the upper footrest extension link 92. Additional aspects of the extension of the footrests 17*a*, 17*b* may be discussed in U.S. Pat. No. 8,752,890 to Murphy et al., the disclosure of which is hereby incorporated herein by reference in its entirety.

Also, the rotation and movement of the lower footrest swing link 84 and the pin 50 attached thereto draws the coupling link 48 counterclockwise about the pivot 52 as its upper end travels with the pin 50 rearwardly in the slot 22*a*. This causes the seat link 22 and seat 13 to rise slightly and take on a slightly angled pitch (the pitch angle may be between about 5 and 15 degrees). This movement draws the lower end of the segment 36*a* of the carrier link 36 slightly forwardly and upwardly. Rotation of the lower footrest link 84 also draws the extension 54 forward, which movement, combined with the rising of the seat link 22, draws the front end of the connecting link 44 forwardly and slightly upwardly. These movements pull the lower end of the backpost 42 forwardly and cause the backpost 42, and in turn the backrest 15, to rotate counterclockwise about the pivot 40 into a reclined disposition (typically the backrest 15 forms an angle of between about 30 and 50 degrees relative to horizontal).

Notably, in the upright position (see FIG. 1) all of the links of the footrest linkage 83 and the linear actuator 130 reside below the front portion of the seat 13. This configuration may enable the seating unit 10 to be mounted on the tread 16 and riser 18 of an existing riser arrangement without modification of the riser arrangement. In the illustrated embodiment, the footrest linkage 83 and the linear actuator 130 are able fit within a "pocket" below the seat 13 and in front of the tread 18 that is between about 10 and 16 inches in height and between about 10 and 15 inches in "depth" (measured in the longitudinal dimension). This capability is facilitated by the upward angle at which the linear actuator 130 is mounted in the upright position. This capability may also be facilitated by the movement of the entire linear actuator 130 (including the motor 132) with the carrier link 36 when moving from the upright to the fully reclined position.

Also, the seating unit 10 has the capability of reaching the fully reclined position (in which the backrest 15 is reclined to between about 30 and 50 degrees) while still providing a reasonable seating height (e.g., between about 17 and 23 inches above the floor surface below the front portion of the seat 13). This is facilitated by the carrier link 36, which both underlies the rear portion of the seat 13 and provides a low mounting point for the linear actuator 130. This capability is also facilitated by the coupling of the coupling link 48 with the lower footrest swing link 84 via the pin 50 and the rearward travel of this pivot point within the slot 22*b* on the seat frame 22.

Figure 7:
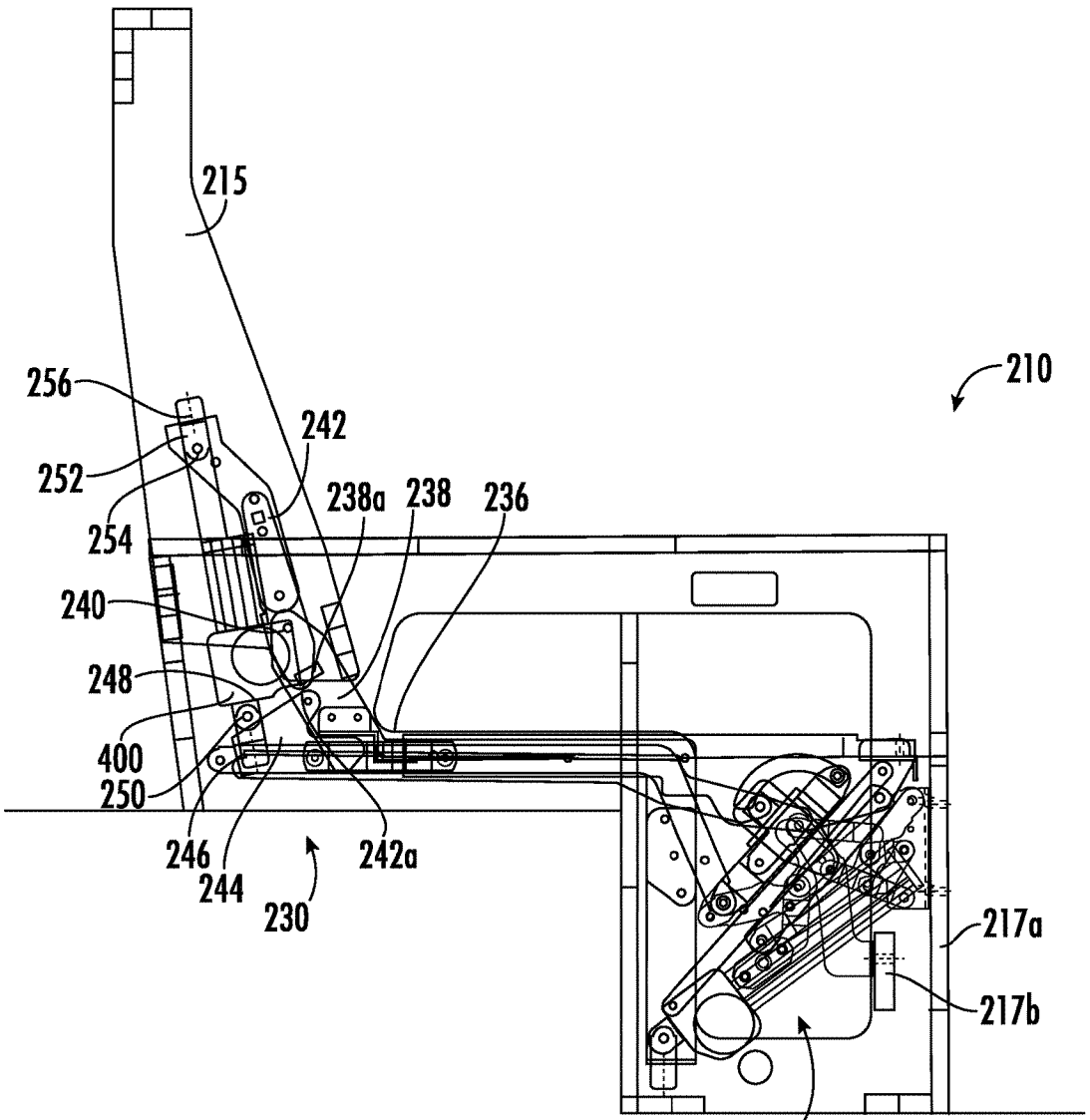
FIG. 7 is a side view of a seating unit according to alternative embodiments of the invention, show in the upright position.
Figure 8:
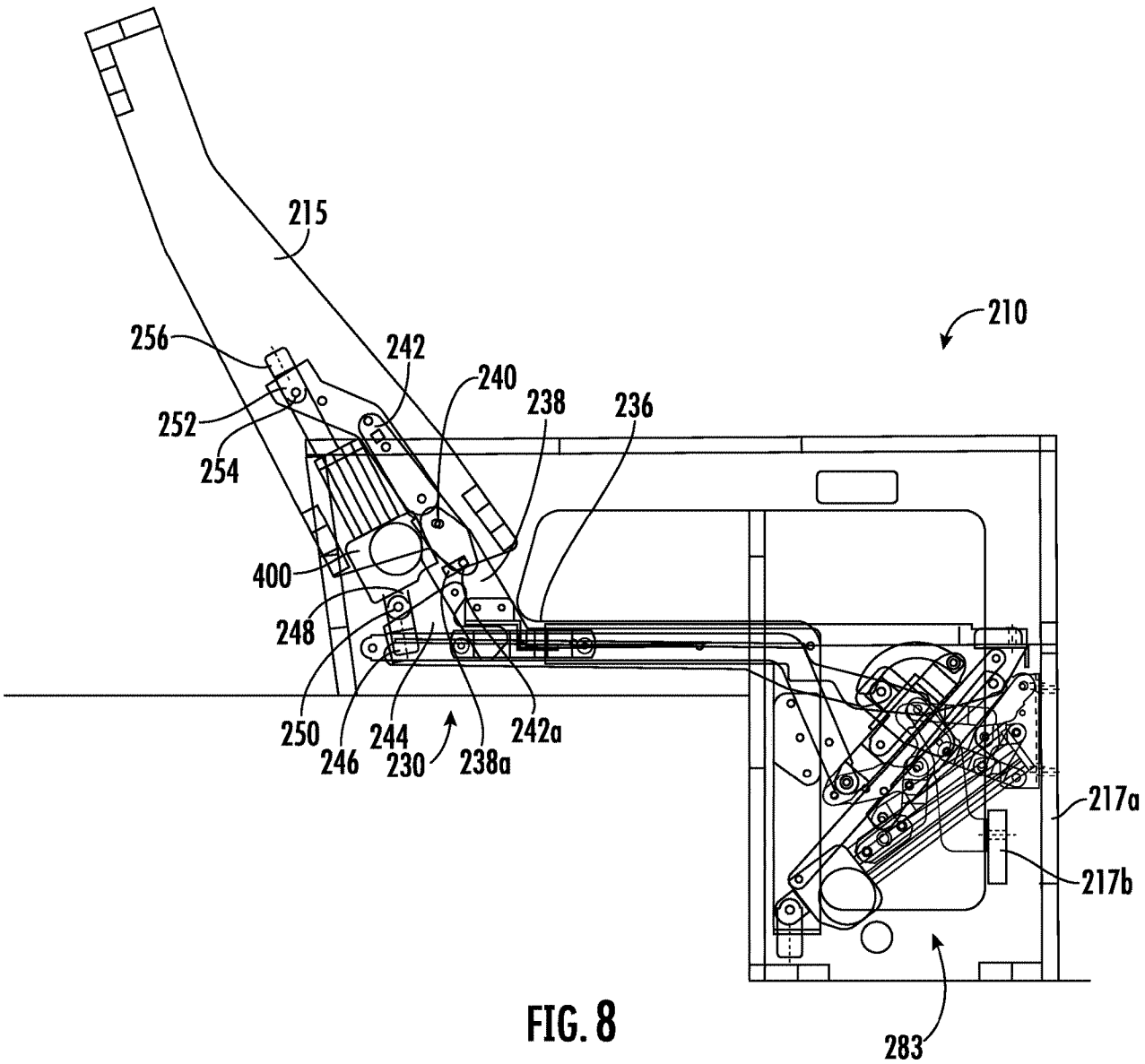
FIG. 8 is a side view of the seating unit of FIG. 7, with the backrest in a fully reclined position, but with the footrest retracted.

Those of skill in this art will appreciate that the seating unit 10 may take other forms. For example, the seating unit 10 may include more than one linear actuator, wherein one actuator controls the reclining of the backrest and the other controls the extension of the footrest(s). One example of such a design is shown in FIGS. 7 and 8 and designated broadly at 210. The seating unit 210 includes a footrest linkage 283 that is essentially the same as the footrest linkage 83 discussed above. The seating unit 210 also includes a reclining mechanism 230 that is largely similar to the reclining mechanism 30 discussed above. However, the seating unit 210 includes a second linear actuator 400 that allows the backrest 215 to recline independently of the extension/retraction of the footrests 217*a*, 217*b*. The differences in the reclining mechanisms 30, 230 are discussed below.

Referring first to FIG. 7, the reclining mechanism 230 includes a carrier link 236 that with a projection 238 that is smaller than the projection 38. A two-piece backpost 242 is pivotally attached to the projection 238 at a pivot 240 and also engages the projection 238 via a pin 240*a* that is received in a slot 238*a* in the projection 238. Another projection 244 is fixed to and extends rearwardly from the carrier link 236 and the projection 238. A cross-member 246 extends between the projections 244 on either side of the seating unit 210. A bracket 248 is fixedly mounted on the cross-member 246. The linear actuator 400 is mounted at a pivot 250 to the bracket 248 and extends upwardly therefrom to a pivot 254 with a bracket 252. The bracket 252 is mounted to a cross-member 256 that extends between and is fixed to the upper ends of the backposts 242 on either side of the seating unit 210. The backrest 215 is fixed to the backpost 242.

In the upright position (FIG. 7), the linear actuator 400 is fully extended, and the pin 242*a* is positioned in the rear end of the slot 238*a*. In this position the backrest 215 is relatively upright. When an occupant of the seating unit 210 wishes to recline the backrest 215, the occupant activates the linear actuator 400 to retract. This movement draws the upper end of the backpost 242 downwardly, which in turn causes the backpost 242 to rotate counterclockwise about the pivot 250. This action of the backpost 242 draws the backrest 215 into a more reclined position (see FIG. 8). The backrest 215 is fully reclined when the pin 242*a* reaches the forward end of the slot 238*a*. Thus, it can be seen that the backrest 215 of the seating unit 210 can be reclined without extending the footrests 217*a*, 217*b*. (Conversely, the footrests 217*a*, 217*b* can be extended in front of the seat 214 in the manner described above using the linear actuator 300 without reclining the backrest 215).

As another exemplary variation, the seating unit 10 may also be constructed such that, when reclined, the angle between the seat and backrest does not change. Further, the type of linear actuator employed may vary (e.g., a telescoping design, in which a rod retracts and extends, may also be used). Other variations may also be apparent to those of skill in this art.

It should also be noted that, although the seating unit is illustrated for use with a riser arrangement, such as that employed in a theater, the seating unit 10 may be used in other settings. For example, in some instances the arms may lack a cutaway area, and the reclining mechanism may be used with a conventional chair. Such a chair may be particularly suitable for use in a health care environment.

Further, it should be apparent that the occupant may choose to cease movement of the seating unit at any point between the upright and fully reclined positions by simply halting the movement of the carriage of the linear actuator on the rail.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

What is claimed is:

1. A reclining seating unit, comprising:

a frame having a pair of arms, wherein each of the arms includes a cutaway portion in a lower rear area thereof, the cutaway portion configured to receive a tread and a riser of a riser arrangement;

a backrest;

a seat;

a first footrest;

a reclining mechanism connected between the backrest, seat, and first footrest, the reclining mechanism comprising a series of pivotally interconnected links and configured to move the seating unit between: (a) an upright position, in which the backrest is disposed at a first generally upright backrest angle relative to the seat, the seat is disposed at a first generally horizontal seat angle, and the first footrest is retracted below a forward portion of the seat; and (b) a fully reclined position, in which the backrest is disposed at a second backrest angle relative to horizontal that is shallower than the first backrest angle, the first footrest is extended in front of the seat, and the seat has a second seat angle that is steeper relative to horizontal than the first seat angle;

wherein the reclining mechanism includes a footrest mechanism attached to the first footrest, the footrest mechanism configured to control relative movement of the first footrest relative to the seat;

a linear actuator attached to the reclining mechanism and the footrest linkage and configured to move the backrest, seat and first footrest between the upright and fully reclined positions;

wherein the linear actuator and the footrest linkage reside entirely below a front portion of the seat and in front of the cutaway portion of the arms.

2. The seating unit defined in claim 1, wherein the cutaway portion is defined by a front edge and an upper edge, and wherein the front edge is substantially perpendicular to the upper edge.

3. The seating unit defined in claim 1, wherein the linear actuator includes a rail, and wherein the rail is disposed at an angle of at least 30 degrees in the upright position.

4. The seating unit defined in claim 1, further comprising a second footrest, wherein in the upright position, the second footrest is generally vertically disposed and rearward of the first footrest, and in the fully reclined position the second footrest is generally horizontally disposed and forward of the first footrest.

5. The seating unit defined in claim 1, wherein the reclining mechanism includes a seat frame that underlies and moves with the seat, the footrest linkage includes a lower footrest swing link, the reclining mechanism further includes a coupling link that is pivotally attached to the arm frame, and the lower footrest swing link and the coupling link are pivotally attached to each other and to the seat frame at a first pivot point.

6. The seating unit defined in claim 5, wherein the first pivot point is movable relative to the seat frame within an arcuate slot.

7. The seating unit defined in claim 1, wherein the reclining mechanism further includes a carrier link that is fixed relative to the seat frame, and wherein the linear actuator is pivotally attached to a lower forward end portion of the carrier link.

8. The seating unit defined in claim 7, wherein the backrest is fixed to a backpost, and wherein the carrier link is pivotally connected to the backpost.

9. A reclining seating unit, comprising:

a frame having a pair of arms;

a backrest;

a seat;

a first footrest;

a reclining mechanism connected between the backrest, seat, and first footrest, the reclining mechanism comprising a series of pivotally interconnected links and configured to move the seating unit between: (a) an upright position, in which the backrest is disposed at a first generally upright backrest angle relative to the seat, the seat is disposed at a first generally horizontal seat angle, and the first footrest is retracted below a forward portion of the seat; and (b) a fully reclined position, in which the backrest is disposed at a second backrest angle relative to horizontal that is shallower than the first backrest angle, the first footrest is extended in front of the seat, and the seat has a second seat angle that is steeper relative to horizontal than the first seat angle;

wherein the reclining mechanism includes a footrest mechanism attached to the first footrest, the footrest mechanism configured to control relative movement of the first footrest relative to the seat;

a linear actuator attached to the reclining mechanism and the footrest linkage and configured to move the backrest, seat and first footrest between the upright and fully reclined positions;

wherein the linear actuator includes a rail, and wherein the rail defines a first angle relative to horizontal of at least 30 degrees in the upright position, and further defines a second angle relative to horizontal that is larger than the first angle in the fully reclined position.

10. The seating unit defined in claim 9, further comprising a second footrest, wherein in the upright position, the second footrest is generally vertically disposed and rearward of the first footrest, and in the fully reclined position the second footrest is generally horizontally disposed and forward of the first footrest.

11. The seating unit defined in claim 10, wherein the reclining mechanism includes a seat frame that underlies and moves with the seat, the footrest linkage includes a lower footrest swing link, the reclining mechanism further includes a coupling link that is pivotally attached to the arm frame, and the lower footrest swing link and the coupling link are pivotally attached to each other and to the seat frame at a first pivot point.

12. The seating unit defined in claim 11, wherein the first pivot point is movable relative to the seat frame within an arcuate slot.

13. The seating unit defined in claim 11, wherein the reclining mechanism further includes a carrier link that is fixed relative to the seat frame, and wherein the linear actuator is pivotally attached to a lower forward end portion of the carrier link.

14. The seating unit defined in claim 13, wherein the backrest is fixed to a backpost, and wherein the carrier link is pivotally connected to the backpost.

15. A reclining seating unit, comprising:

a frame having a pair of arms, wherein each of the arms includes a cutaway portion in a lower rear area thereof, the cutaway portion configured to receive a tread and a riser of a riser arrangement;

a backrest;

a seat;

a first footrest;

a reclining mechanism connected between the backrest, seat, and first footrest, the reclining mechanism comprising a series of pivotally interconnected links and configured to move the seating unit between: (a) an upright position, in which the backrest is disposed at a first generally upright backrest angle relative to the seat, the seat is disposed at a first generally horizontal seat angle, and the first footrest is retracted below a forward portion of the seat; and (b) a fully reclined position, in which the backrest is disposed at a second backrest angle relative to horizontal that is shallower than the first backrest angle, the first footrest is extended in front of the seat, and the seat has a second seat angle that is steeper relative to horizontal than the first seat angle;

wherein the reclining mechanism includes a footrest mechanism attached to the first footrest, the footrest mechanism configured to control relative movement of the first footrest relative to the seat;

a linear actuator attached to the reclining mechanism and the footrest linkage and configured to move the backrest, seat and first footrest between the upright and fully reclined positions;

wherein the reclining mechanism includes a seat frame that underlies and moves with the seat, the footrest linkage includes a lower footrest swing link, the reclining mechanism further includes a coupling link that is pivotally attached to the arm frame, and the lower footrest swing link and the coupling link are pivotally attached to each other and to the seat frame at a first pivot point; and wherein the first pivot point is movable relative to the seat frame within an arcuate slot.

16. The seating unit defined in claim 15, wherein the linear actuator includes a rail, and wherein the rail is disposed at an angle of at least 30 degrees in the upright position.

17. The seating unit defined in claim 15, further comprising a second footrest, wherein in the upright position, the second footrest is generally vertically disposed and rearward of the first footrest, and in the fully reclined position the second footrest is generally horizontally disposed and forward of the first footrest.

18. The seating unit defined in claim 15, wherein the reclining mechanism further includes a carrier link that is fixed relative to the seat frame, and wherein the linear actuator is pivotally attached to a lower forward end portion of the carrier link.

19. The seating unit defined in claim 18, wherein the backrest is fixed to a backpost, and wherein the carrier link is pivotally connected to the backpost.

20. A reclining seating unit, comprising:

a frame having a pair of arms;

a backrest;

a seat;

a first footrest;

a reclining mechanism connected between the backrest, seat, and first footrest, the reclining mechanism comprising a series of pivotally interconnected links and configured to move the seating unit between: (a) an upright position, in which the backrest is disposed at a first generally upright backrest angle relative to the seat, the seat is disposed at a first generally horizontal seat angle, and the first footrest is retracted below a forward portion of the seat; and (b) a fully reclined position, in which the backrest is disposed at a second backrest angle relative to horizontal that is shallower than the first backrest angle, the first footrest is extended in front of the seat, and the seat has a second seat angle that is steeper relative to horizontal than the first seat angle;

wherein the reclining mechanism includes a footrest mechanism attached to the first footrest, the footrest mechanism configured to control relative movement of the first footrest relative to the seat;

a first linear actuator attached to the reclining mechanism and the footrest linkage and configured to move the seat and first footrest between the upright and fully reclined positions;

a second linear actuator attached to the backrest and configured to move the backrest between upright and fully reclined positions;

wherein the first linear actuator includes a rail, and wherein the rail defines an angle relative to horizontal of at least 30 degrees in the upright position; and wherein the reclining mechanism includes a seat frame that underlies and moves with the seat, the footrest linkage includes a lower footrest swing link, the reclining mechanism further includes a coupling link that is pivotally attached to the arm frame, and the lower footrest swing link and the coupling link are pivotally attached to each other and to the seat frame at a first pivot point; and wherein the first pivot point is movable relative to the seat frame within an arcuate slot.

21. A reclining seating unit, comprising:

a frame having a pair of arms, wherein each of the arms includes a cutaway portion in a lower rear area thereof, the cutaway portion configured to receive a tread and a riser of a riser arrangement;

a backrest;

a seat;

a first footrest;

a reclining mechanism connected between the backrest, seat, and first footrest, the reclining mechanism comprising a series of pivotally interconnected links and configured to move the seating unit between: (a) an upright position, in which the backrest is disposed at a first generally upright backrest angle relative to the seat, the seat is disposed at a first generally horizontal seat angle, and the first footrest is retracted below a forward portion of the seat; and (b) a fully reclined position, in which the backrest is disposed at a second backrest angle relative to horizontal that is shallower than the first backrest angle, the first footrest is extended in front of the seat, and the seat has a second seat angle that is steeper relative to horizontal than the first seat angle;

wherein the reclining mechanism includes a footrest mechanism attached to the first footrest, the footrest mechanism configured to control relative movement of the first footrest relative to the seat;

a linear actuator attached to the reclining mechanism and the footrest linkage and configured to move the backrest, seat and first footrest between the upright and fully reclined positions;

wherein the linear actuator resides entirely below a front portion of the seat and in front of the cutaway portion of the arms.

22. The reclining seating unit defined in claim 21, wherein the linear actuator includes a rail, and wherein the rail defines a first angle relative to horizontal of at least 30 degrees in the upright position, and further defines a second angle relative to horizontal that is larger than the first angle in the fully reclined position.

* * * * *